US007172178B1

(12) United States Patent
Hacker

(10) Patent No.: US 7,172,178 B1
(45) Date of Patent: Feb. 6, 2007

(54) CARBURETOR WITH ACCELERATION FUEL PUMP

(75) Inventor: David D. Hacker, Bad Axe, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 148 days.

(21) Appl. No.: 10/996,962

(22) Filed: Nov. 24, 2004

(51) Int. Cl.
*F02M 7/08* (2006.01)

(52) U.S. Cl. ..... 261/34.2; 261/35

(58) Field of Classification Search ..... 261/34.2, 261/35; 123/437
See application file for complete search history.

(56) References Cited

U.S. PATENT DOCUMENTS 2,551,719 A * 5/1951 Ball ..... 261/34.2
2,660,417 A * 11/1953 Anderson ..... 261/34.2
2,768,818 A * 10/1956 Egerer ..... 261/23.2
2,775,435 A * 12/1956 Kommer ..... 261/34.2
3,017,167 A * 1/1962 Griffen ..... 261/34.2
3,404,872 A * 10/1968 Nutten ..... 261/34.2
4,076,770 A * 2/1978 Saito et al. ..... 261/34.2
6,293,524 B1 9/2001 Endo et al. ..... 261/34.2
6,382,599 B1 5/2002 Aihara et al. ..... 261/37
6,481,699 B1 11/2002 Aihara et al. ..... 261/34.2
2002/0163087 A1* 11/2002 Gerhardy ..... 261/34.2

FOREIGN PATENT DOCUMENTS

JP 52-43026 * 4/1977 ..... 261/34.2

* cited by examiner

*Primary Examiner*—Richard L. Chiesa
(74) *Attorney, Agent, or Firm*—Reising, Ethington, Barnes, Kisselle, P.C.

(57) ABSTRACT

A combustion engine carburetor with a fuel-and-air mixing passage extending through a body and a float bowl engaged sealably to the body. A vacuum actuated acceleration fuel pump is preferably carried by the float bowl and has a hose-less vacuum channel communicating between the fuel-and-air mixing passage downstream of a throttle valve and a vacuum chamber of the acceleration pump. A hose-less fuel discharge channel communicates between a supplemental fuel chamber of the acceleration pump and the fuel-and-air mixing passage between a venturi and a choke valve in the mixing passage. Preferably, the fuel discharge channel has an injecting bore portion defined by the body and being angled to direct fuel in a downstream direction toward the venturi to promote mixing with air.

15 Claims, 5 Drawing Sheets

CARBURETOR WITH ACCELERATION FUEL PUMP

TECHNICAL FIELD

This invention relates to combustion engine carburetors and more particularly to a carburetor having an acceleration fuel pump without external hoses.

BACKGROUND OF THE INVENTION

In a conventional prior art carburetor 20 as best illustrated in FIG. 1, a fuel-and-air mixing passage 22 extends through a carburetor body 24 providing a fuel-and-air mixture to the crankcase of a two cycle combustion engine or to an intake manifold of a four cycle engine. A throttle valve (not shown) orientated in a downstream region of the fuel-and-air mixing passage 22 controls the fuel-and-air mixture flow, which in-part controls the speed and power of the operating engine. Similarly, a choke valve 26 is orientated in an upstream region 28 of the mixing passage 22 and controls the amount of air flow through a venturi of the mixing passage 22 which is located between the throttle and choke valves. A main fuel feed tube communicates transversely with the mixing passage 22 at the venturi to flow liquid fuel from a fuel chamber or bowl and into the passage to mix with the flowing air. The amount of liquid fuel emitted is dependent upon the amount of vacuum created at the venturi by the operating engine and positioning of the valves.

During cold engine starts, a rich mixture of fuel-and-air is needed. To produce the rich mixture, the throttle valve is substantially open exposing the fuel feed tube or nozzle to the vacuum of the cranking engine, and the choke valve 26 is generally closed to reduce air flow. When the engine is idling at operating temperature, the throttle valve is substantially closed (typically slightly open or closed with a notch or hole therein permitting sufficient mixture flow to support engine idling or low load operation) producing a high vacuum condition downstream of the throttle valve and the choke valve is open. The closed throttle valve reduces air flow through the venturi which reduces liquid fuel flow emitted from the fuel feed tube. The resulting low fuel-and-air mixture flow rate coincides with the needs of the engine running at idle, or low speed or low load. During steady, high speed and full load engine operation, the throttle and choke valves are generally wide open causing a high air flow rate through the venturi which produces a high vacuum for emitting a commensurate amount of fuel through the main fuel feed tube.

For smooth engine acceleration from idle, however, and generally as the throttle valve is opening, the engine requires a richer mixture of fuel-and-air than at hot idle or high speed light load. A diaphragm-type acceleration pump 30 supplies this additional amount of fuel by sensing vacuum pressure changes downstream of the throttle valve. When the engine is idling and the throttle valve is substantially closed, the vacuum pressure downstream of the substantially closed throttle valve is generally high. For example, in a typical four cycle engine application the vacuum can be about ten inches of mercury. An external conduit or hose 32 of the pump 30 communicates this vacuum with a vacuum chamber defined in part by the diaphragm of the pump. When the vacuum is high (i.e. ten inches of mercury), the diaphragm is flexed into the vacuum chamber thus maximizing the volume of a supplemental fuel chamber defined in-part by an opposite side of the diaphragm. When the engine is accelerating, the throttle valve is opening causing the vacuum pressure to drop, for example, down to about one inch of mercury. This drop in vacuum is sensed by the pump 30 through the hose 32 and joining tube fittings 34, 36 causing the diaphragm via the assistance of a compression spring to move into the supplemental fuel chamber which pushes the supplemental fuel through a discharge hose 38 coupled to joining connector tube fittings 40, 42 by clamps 44, 46, and into the fuel-and-air mixing passage 22 immediately upstream of the venturi.

As shown in the illustration of FIG. 1, the acceleration fuel pump 30 is formed into a float bowl 48 of the carburetor 20 in such a way that the fuel chamber of the pump is defined between the diaphragm and the float bowl 48. The vacuum chamber is defined between the diaphragm and a pump cover 50 attached to the float bowl by screws 52. Unfortunately, and even with the integration of the pump 30 into the float bowl 48, the carburetor 20 still requires a plurality of external parts to communicate the acceleration pump with the fuel-and-air mixing passage 22. For instance, the fuel discharge channel and the vacuum-sensing channel require the fittings, hoses, and clamps previously described. The supply and assembly of these parts is costly, leads to maintenance concerns and each connection is a source for a potential leak. Yet further, many portions of the various channels require drilling passages into the body 24 of the carburetor 20 at compound angles which also require various plugs to seal an open end of the passages.

SUMMARY OF THE INVENTION

A combustion engine carburetor with a fuel-and-air mixing passage extending through a body engaged sealably to a fuel float bowl and a vacuum actuated acceleration fuel pump, preferably carried by the float bowl, has a hose-less vacuum channel communicating the fuel-and-air mixing passage downstream of a throttle valve with a vacuum chamber of the acceleration pump. A hose-less fuel discharge channel communicates a supplemental fuel chamber of the acceleration pump with the fuel-and-air mixing passage between a venturi and a choke valve in the mixing passage. Preferably, the discharge channel has a fuel injecting bore portion in the body angled to direct a fuel spray in a downstream direction toward the venturi to promote mixing with air.

Preferably, the hose-less vacuum channel has a cast recess portion in the body and/or float bowl which communicates through the bore directly with the fuel-and-air mixing passage. Preferably the recess is in one of the sealing faces of mating body and float-bowl flanges. Preferably the recess also communicates directly through a bore in the float bowl with the vacuum chamber of the acceleration pump.

Objects, features and advantages of this invention include a carburetor having an acceleration pump which does not require external hoses, tubes, fittings and/or clamps to communicate with a vacuum source or deliver supplemental fuel, reduces the likelihood of fuel leaks, has only internal communication passages, improves fuel and air mixing during acceleration for improved emissions and engine performance, decreases the number of parts required, is rugged, durable, maintenance free, of relatively simple design and economical manufacture and assembly, and in service has a long useful life.

DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
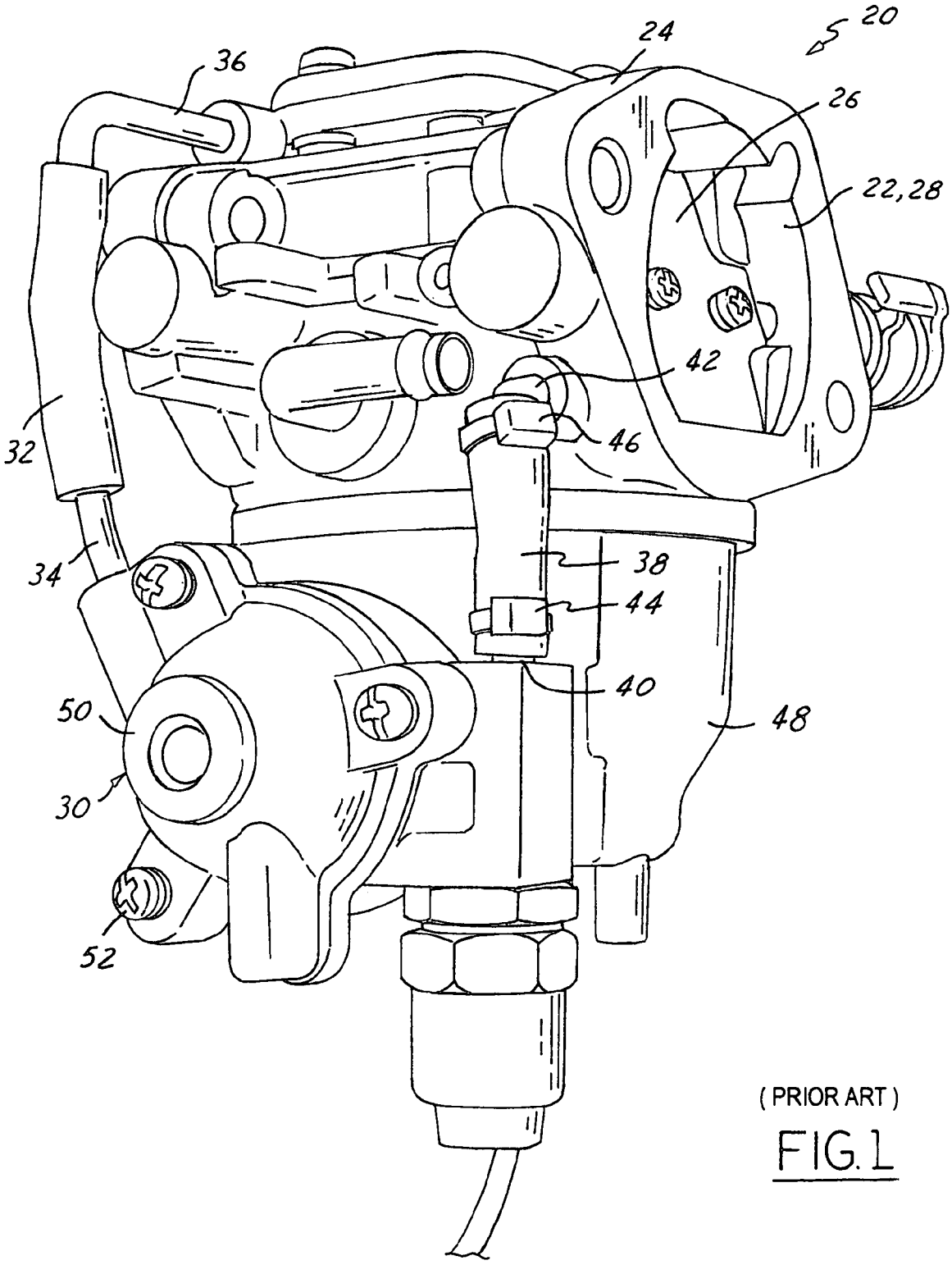
( PRIOR ART ) FIG. 1
FIG. 1 is a perspective view of a prior art carburetor having an acceleration fuel pump with external hoses.

Referring in more detail to the drawings, FIGS. 2–8 illustrate a float-bowl type carburetor 60 embodying the present invention. The carburetor 60 has a fuel-and-air mixing passage 62 which extends through a carburetor body 64 for flowing a fuel-and-air mixture typically to the intake manifold of a four stroke engine or alternatively, to the crankcase of a two stroke combustion engine. A throttle valve 66 orientated in a downstream region 68 of the fuel-and-air mixing passage 62 generally controls the fuel-and-air mixture flow rate, which in-part controls the speed and power of the operating engine. Similarly, a choke valve 70 is orientated in an upstream region 72 of the mixing passage 62 and controls the amount of air flow through a venturi 74 of the mixing passage 62 which is located between the throttle and choke valves 66, 70.

Figure 2:
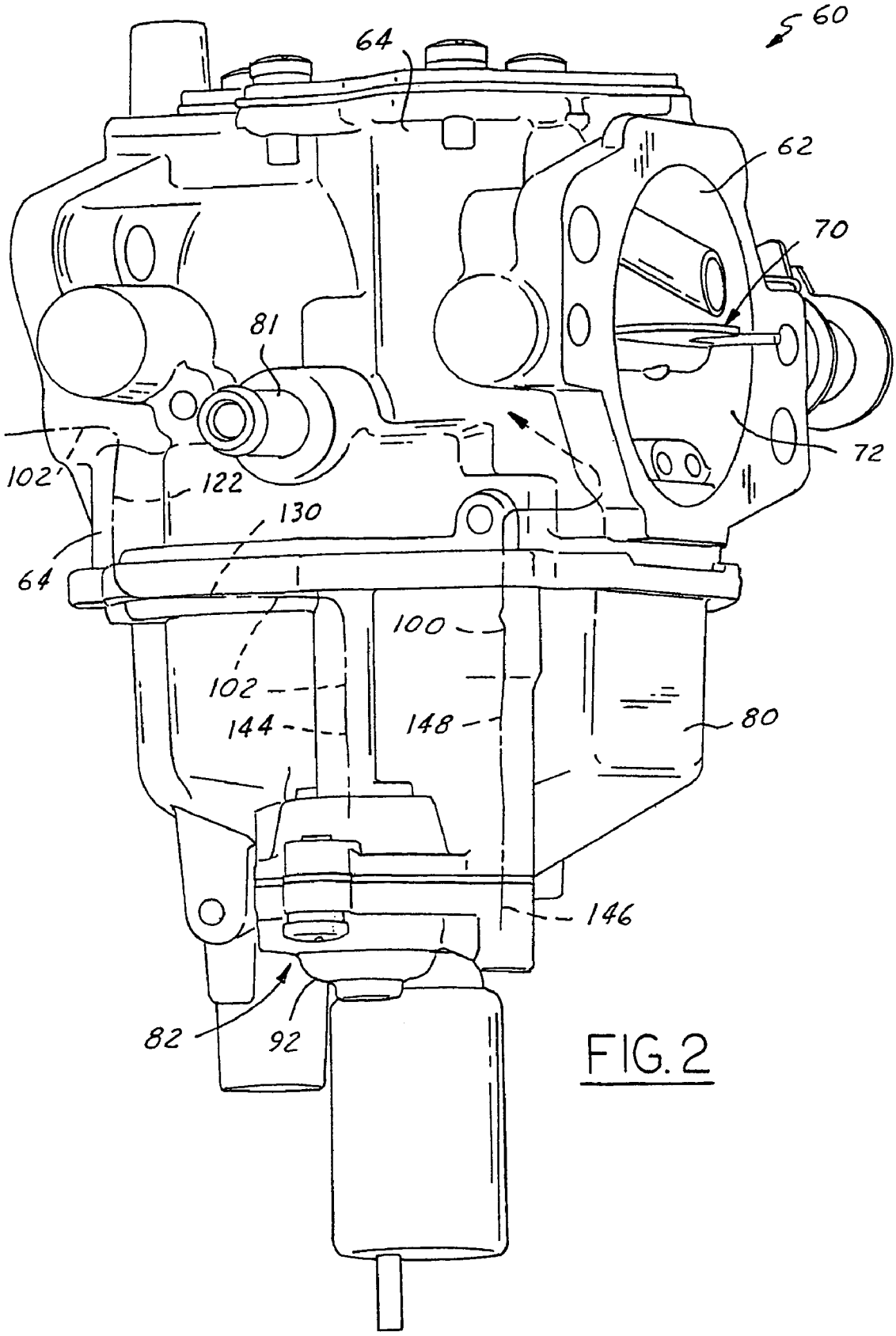
FIG. 2 is a perspective view of a carburetor embodying the present invention.
Figure 7:
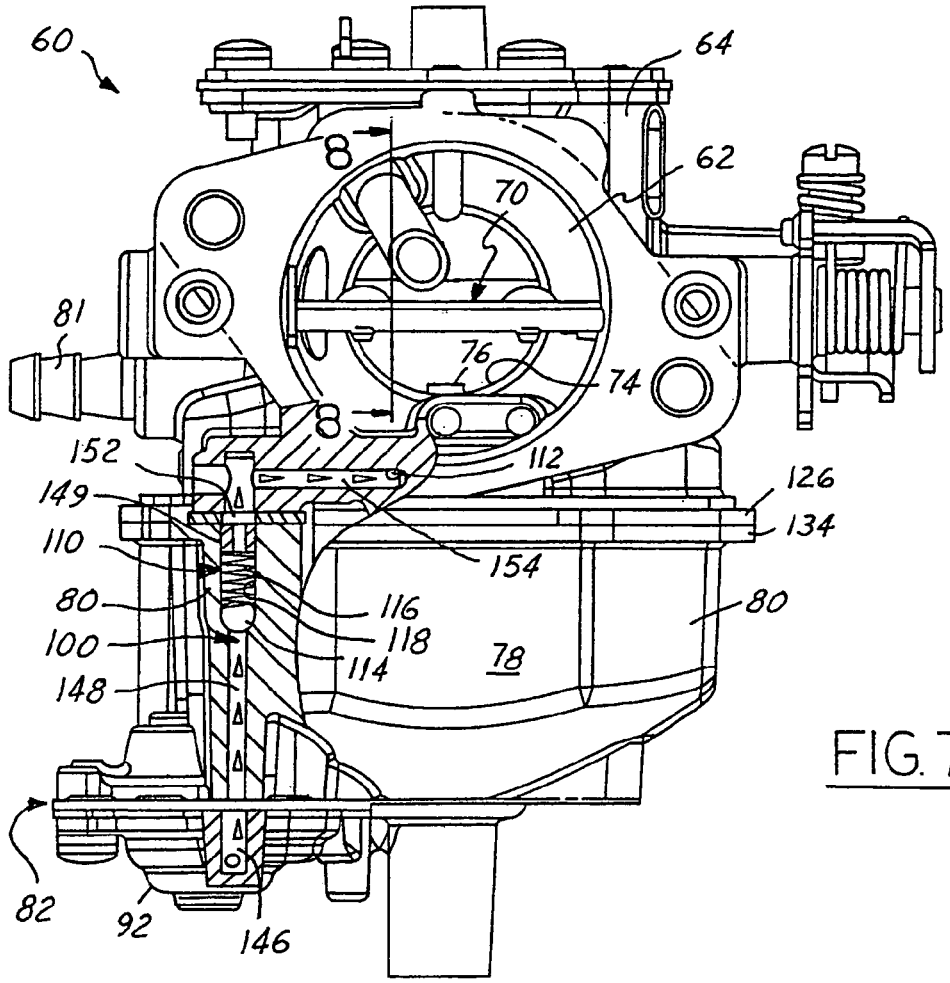
FIG. 7 is an outlet end view of the carburetor with a portion in section to show internal detail of a discharge passage and taken along line 7—7 of FIG. 5.
Figure 8:
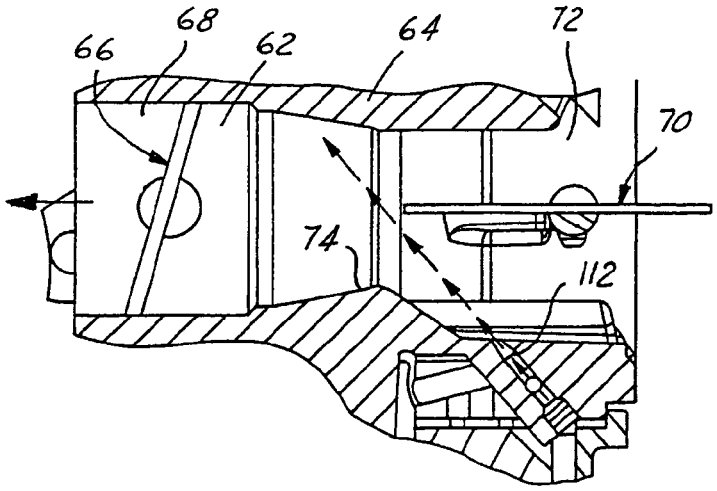
FIG. 8 is a partial cross sectional view of the carburetor taken along line 8—8 of FIG. 7.

Referring to FIGS. 2, 7 and 8, a main fuel feed tube or nozzle 76 communicates transversely with the mixing passage 62 at the venturi 74 to flow liquid fuel from a fuel reservoir 78 and into the mixing passage 62 to mix with the incoming air. The reservoir 78 is preferably held at atmospheric pressure and is defined by a float bowl 80 generally engaged sealably to the underside of the body 64. The amount of liquid fuel emitted into the passage 62 is generally dependent upon the amount of vacuum created at the venturi 74 by the operating engine and positioning of the valves 66, 70. Make-up fuel is supplied to the reservoir 78 by a level sensing, float-operated, supply valve (not shown) located preferably in the reservoir 78. When the fuel level in the reservoir 78 of the bowl is low, the supply valve opens and fuel flows via gravity from a remote fuel tank, through an inlet nozzle 81 secured to the body 64, and down into the reservoir 78.

For reliable cold engine starts, a rich mixture of fuel-and-air is needed. To produce the rich mixture, the throttle valve 66 is substantially open exposing the fuel feed tube 76 to the vacuum produced by the cranking engine, and the choke valve 70 is generally closed to reduce incoming fresh air flow. When the engine is idling at operating temperature, the throttle valve 66 is substantially closed with an opening therethrough or slightly open producing a high vacuum condition downstream of the throttle valve 66, and the choke valve 70 is open. The substantially closed throttle valve 66 reduces air flow through the venturi 74 which reduces liquid fuel flow emitted from the fuel feed tube 76, or substantially eliminates fuel flow from the tube 76 altogether while causing fuel to flow through a separate fuel idle circuit (not shown) opening into the mixing passage 62 immediately downstream of the substantially closed throttle valve 66. The resulting relatively low fuel-and-air mixture flow rate coincides with the needs of the engine running at idle or low speed. During steady, high speed, engine operation, the throttle and choke valves 66, 70 are generally wide open causing a high air flow rate through the venturi 74 which creates a high vacuum for emitting a commensurate amount of fuel through the main fuel feed tube 76.

The carburetor 60 has an acceleration fuel pump 82 (FIG. 4) for adding supplemental fuel to the fuel-and-air mixture during periods of engine acceleration. The supplemental fuel provides a richer mixture of fuel-and-air for smooth acceleration from idle to wide open throttle, regardless of engine temperature. Upon completion of acceleration and during steady state engine operation, the mixture leans-out, thus minimizing exhaust emissions. The pump 82 has a dynamic vacuum chamber 84 preferably defined between a top side 86 of a resilient diaphragm 88 and a generally downward facing surface 89 of the float bowl 80. A supplemental fuel chamber 90 of the pump 82 is located generally below the fuel reservoir 78 and is defined between a bottom cover 92 of the pump 82 and an opposite downward side 94 of the diaphragm 88.

Figure 3:
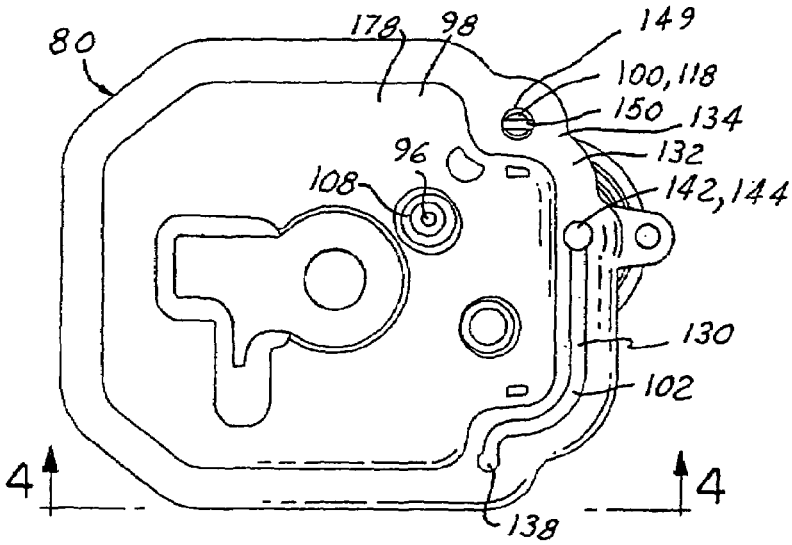
FIG. 3 is a top plan view of a float bowl of the carburetor.
Figure 4:
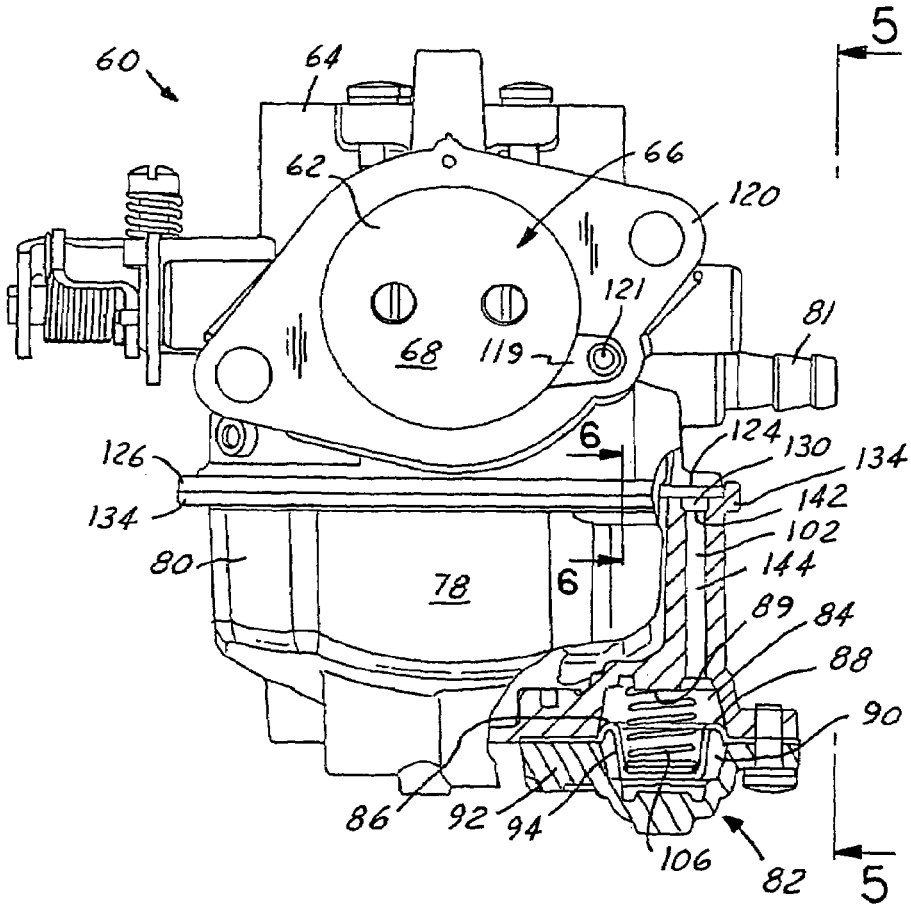
FIG. 4 is an inlet end view of the carburetor with an acceleration pump in section to show internal detail and taken along line 4—4 of FIG. 3.

As best shown in FIGS. 3, 4 and 7, liquid fuel enters the fuel chamber 90 from the fuel reservoir 78 by a port 96 carried by a bottom 98 of the float bowl 80, and fuel exits the chamber 90 by a discharge channel 100 preferably defined completely by the float bowl 80 and the body 64 of the carburetor 60. As shown in FIGS. 2–5, vacuum sensing channel 102 communicates between the downstream region 68 of the mixing passage 62 and the vacuum chamber 84. Similar to the fuel discharge channel 100, the vacuum channel 102 is defined completely by the float bowl 80 (FIGS. 3 and 4), the body 64 (FIG. 5), and preferably generally a gasket 104 (FIGS. 6 and 9) used to seal the body to the float bowl. In totality, the acceleration fuel pump 82 interfaces with the remainder of the carburetor 60 without the use of external hoses, nozzles, clamps and the like. The lack of such components decreases any chance of system failure, leaks of vacuum and/or fuel, improves packaging and minimizes manufacturing costs.

As previously described, when the engine is running at idle, the throttle valve 66 is substantially closed and the vacuum pressure downstream of the throttle valve 66 is generally high, such as about ten inches of mercury in the intake manifold of a typical four cycle engine application. This high vacuum is communicated through the vacuum channel 102 to the vacuum chamber 84 and the negative pressure placed across the top side 86 of the diaphragm 88 produces an upward force which overcomes a downward force produced by a compression spring 106 disposed in the vacuum chamber 84 and generally compressed between the top side 86 of the diaphragm 88 and the bottom surface 89 of the float bowl 80 (as best shown in FIG. 4). With the spring force overcome, the diaphragm 88 rises or flexes into the vacuum chamber 84 causing the fuel chamber 90 to enlarge thus flowing fuel from the reservoir 78, through the intake port 96 and a check valve 108 such as a ball-type, and into the fuel chamber 90 creating a primed-condition of the pump 82.

Figure 5:
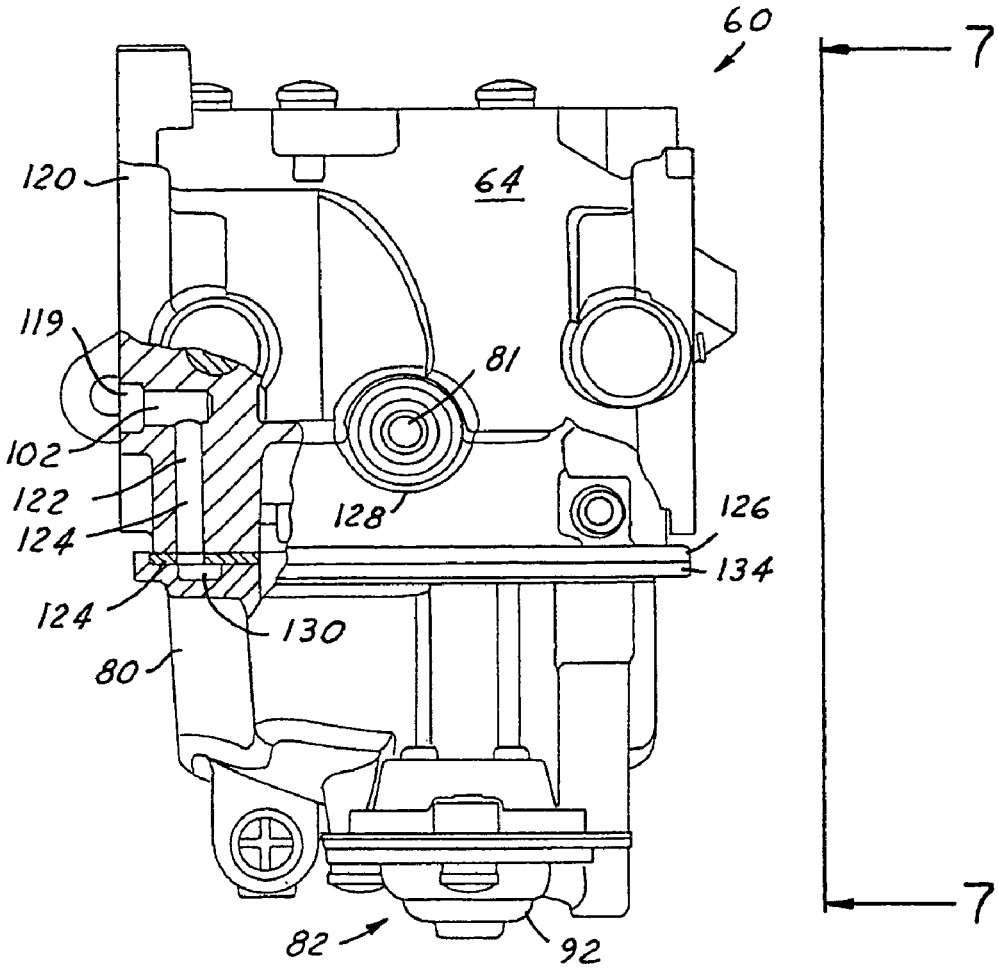
FIG. 5 is a side view of the carburetor with a portion in section to show internal detail of a vacuum passage and taken along line 5—5 of FIG. 4.
Figure 6:
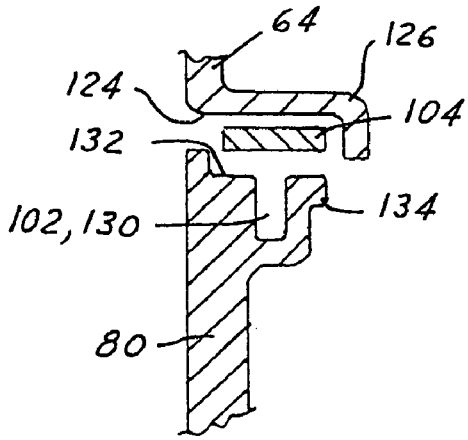
FIG. 6 is an enlarged fragmentary cross section detailing the vacuum passage and taken along line 6—6 of FIG. 4.
Figure 9:
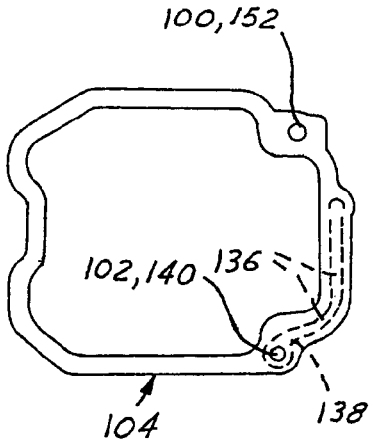
FIG. 9 is a top view of a gasket of the carburetor.

Referring to FIGS. 4–5, the vacuum channel 102 has a recess or pocket 119 and a blind bore 121 which is preferably cast into a mounting flange 120 of the body 64 and communicates directly with the downstream region 68 of the mixing passage 62. A substantially vertical and linear bore portion 122 of the channel 102 is in the body 64 and communicates directly with the blind bore 121 of the pocket 119. The bore portion 122 extends from the pocket 119 and through a continuous face 124 of a flange 126 of the body 64 at a port 128 opening into the face 124. As best shown in FIGS. 3, 5 and 6, the vacuum channel 102 has an elongated recess or groove 130 opened laterally upward and cast into an upward facing peripheral surface 132 carried generally by an outward projecting flange 134 of the float bowl 80. When the carburetor 60 is assembled, the gasket 104 is compressed sealably between the peripheral surface 132 of the float bowl 80 and the continuous face 124 of the outward projecting body flange 126. Consequently, the gasket 104 covers the recess 130 with an elongated "land-locked" section 136 (as best shown in FIG. 9) and seals it from direct communication with the fuel reservoir 78 or external environment, and thereby defines in part the vacuum channel 102.

A hole 140 located through the gasket 104 provides communication between the port 128 of the bore portion 122 and an end 138 of the recess 130. Communicating between an opposite end of the recess 130 at a port 142 and the vacuum chamber 84 of the pump 82 is a second or inlet bore portion 144 which is substantially vertical and defined in the float bowl 80. For ease of manufacturing, the pocket 119 and blind bore 121 are cast into the body 64, and the recess 130 is cast into the float bowl 80, thus eliminating secondary manufacturing operations. After the casting process, the vertical bore portions 122, 144 require only a single drilling each, typically starting at the respective flanges. The drillings are linear, not of complex angles, and do not require sealing plugs. If desired, these bores 122 and 144 could be formed in the casting by using suitable core pins.

Referring to FIGS. 7 and 8, the discharge channel 100 has a bottom segment 146 communicating directly with the supplemental fuel chamber 90 (FIG. 4) and carried by the accelerator pump housing or cover 92. A substantially linear bore segment 148 of the discharge channel 100 is in the float bowl 80 and communicates generally upward from the bottom segment 146 and into the counter-bore 118 which contains a biased closed check valve 110. A fastening device such as a threaded stop 149 with a concentric hole or port 150 secures a spring 116 of the check valve 110 in place. The port 150 is generally positioned flush with the peripheral surface 132 of the float bowl 80 which is aligned with a hole 152 (FIG. 9) carried by the gasket 104 for communication with a substantially horizontal bore segment 154 (FIG. 7) of the discharge channel 100 carried by the body 64 for communication with an injecting bore portion 112 (FIG. 8) of the discharge channel 100.

When the engine accelerates preferably from idle to wide open throttle, the throttle valve 66 rotates from the closed position to an open position causing the vacuum pressure in the downstream region 68 of the mixing passage 62 or intake manifold to drop, for example, from about ten inches of mercury to about one inch of mercury. This sudden drop in vacuum causes the spring 106 to push downward on the diaphragm 88 flexing the diaphragm into the previously expanded fuel chamber 90. This displaces fuel which is blocked from flowing back into the reservoir 78 by the closed check valve 108 and instead flows upward through the discharge channel 100 and the check valve 110 (as best shown in FIG. 7). As best illustrated in FIG. 8, the displaced fuel is injected into the mixing passage 62 immediately upstream of the venturi 74 and downstream of the open choke valve 70. Preferably, the injecting bore portion or nozzle 112 of the discharge channel 100 is at an approximate forty-five degree angle spraying toward the center of the venturi 74 for improved mixing of the fuel emitted with the flowing air (as best shown in FIG. 8).

Upon completion of acceleration and with continued operation at wide open throttle, the diaphragm 88 remains extended into the fuel chamber 90 and thus remains in an unprimed-condition. Without the hydraulic force of supplemental fuel flow exerted upon a ball 114 of the discharge check valve 110, the valve 110 closes upon the opposite biasing force of the spring 116 and the weight of the ball 114. Both the spring 116 and the ball 114 are seated within the substantially vertical counter-bore portion 118 of the discharge channel 100 preferably defined by the float bowl 80. Once closed, the check valve prevents reverse flow of air and/or fuel through the pump 82 and also prevents disruption of the flow dynamics generally between the venturi 74 and the fuel feed tube 76 during steady state engine running conditions. When the engine is not running and vacuum is non-existent, the acceleration pump 82 remains in the unprimed-condition, as best illustrated in FIG. 4.

While the forms of the invention herein disclosed constitute a presently preferred embodiment, many others are possible. For instance, the recess 130 can be cast into the flange 126 of the body 64 instead of the flange 134 of the float bowl 80 and the hole 140 in the gasket 104 relocated to the other end of the recess 130 to communicate with the vertical bore portion 144 of vacuum channel 102. It is not intended herein to mention all the possible equivalent forms or ramifications of the invention. It is understood that terms used herein are merely descriptive, rather than limiting, and that various changes may be made without departing from the spirit or scope of the invention.

The invention claimed is:

1. A combustion engine float bowl carburetor comprising:

a body;

a fuel-and-air mixing passage through the body and having an inlet region and an outlet region;

a vacuum actuated acceleration fuel pump carried by the body;

a hose-less vacuum channel defined by the body and communicating between the acceleration fuel pump and the outlet region of the fuel and air mixing passage;

a float bowl carrying a peripheral surface;

a continuous face carried by the body and engaged sealably to the peripheral surface; and an elongated recess of the vacuum channel extending longitudinally along, and located laterally between, the peripheral surface and the continuous face.

2. The combustion engine carburetor set forth in claim 1 comprising a hose-less fuel discharge channel defined by the body and communicating between the acceleration fuel pump and the inlet region.

3. The combustion engine carburetor set forth in claim 1 comprising a first bore portion of the vacuum channel extending through the body and communicating between the outlet region and the elongated recess.

4. The combustion engine carburetor set forth in claim 3 wherein the acceleration pump is supported by the float bowl.

5. The combustion engine carburetor set forth in claim 4 comprising:

a resilient diaphragm of the acceleration pump;

a vacuum chamber of the acceleration pump defined between the float bowl and the diaphragm; and a second bore portion of the vacuum channel defined by the float bowl and communicating between the elongated recess and the vacuum chamber.

6. The combustion engine carburetor set forth in claim 1 comprising a gasket engaged between the peripheral surface and the continuous face.

7. The combustion engine carburetor set forth in claim 6 comprising a hole located through the gasket and communicating between the first bore portion and an end of the elongated recess.

8. The combustion engine carburetor set forth in claim 7 comprising an elongated section of the gasket being flanked and encompassed by a remaining section of the gasket and wherein the elongated section covers and seals the elongated recess of the vacuum channel.

9. The combustion engine carburetor set forth in claim 1 comprising:

a first port defined by the body and communicating with a first end of the elongated recess; and a second port defined by the float bowl and communicating with an opposite second end of the elongated recess.

10. A combustion engine carburetor having a fuel-and-air mixing passage through a body, a throttle valve in the passage, a venturi upstream of the throttle valve, and a choke valve upstream of the venturi, the carburetor comprising:

a float bowl carried by the body;

a vacuum actuated acceleration fuel pump carried by the body and having a fuel chamber and an actuating vacuum chamber;

a hose-less vacuum channel communicating between the vacuum chamber and the fuel-and-air mixing passage downstream of the throttle valve;

a hose-less fuel discharge channel defined by the body and communicating between the fuel chamber of the acceleration fuel pump and the fuel-and-air mixing passage between the venturi and the choke valve;

a pocket of the vacuum channel defined by the body or the float bowl and communicating with the fuel-and-air mixing passage downstream of the throttle valve; and a bore portion of the vacuum channel defined by the body and communicating between the pocket and a port in a continuous face of the body which is sealed with a peripheral surface of the float bowl.

11. The combustion engine carburetor set forth in claim 10 comprising:

a resilient diaphragm of the acceleration pump;

a float bowl engaged sealably to the body;

a cover of the acceleration pump engaged to the float bowl;

a vacuum chamber of the acceleration pump defined between the float bowl and the diaphragm; and a fuel chamber of the acceleration pump defined between the diaphragm and the cover.

12. The combustion engine carburetor set forth in claim 11 wherein the fuel chamber communicates with the fuel-and-air mixing passage upstream of the venturi via the fuel discharge channel.

13. The combustion engine carburetor set forth in claim 12 comprising an injecting bore portion of the discharge channel defined by the body and communicating directly with the fuel-and-air mixing passage upstream of the venturi and wherein the injecting bore portion is angled to spray fuel in a downstream direction and toward the venturi.

14. The combustion engine carburetor set forth in claim 11 comprising a hose-less vacuum channel defined by the body and the float bowl and communicating between the vacuum chamber and the fuel-and-air mixing passage downstream of the throttle valve.

15. A combustion engine carburetor having a fuel-and-air mixing passage through a body, a throttle valve in the passage, a venturi upstream of the throttle valve, and a choke valve upstream of the venturi, the carburetor comprising:

a vacuum actuated acceleration fuel pump carried by the body;

a resilient diaphragm of the acceleration pump;

a float bowl engaged sealably to the body;

a cover of the acceleration pump engaged to the float bowl;

a vacuum chamber of the acceleration pump defined between the float bowl and the diaphragm;

a fuel chamber of the acceleration pump defined between the diaphragm and the cover;

a hose-less vacuum channel defined by the body and the float bowl and communicating between the vacuum chamber and the fuel-and-air mixing passage downstream of the throttle valve;

a hose-less fuel discharged channel defined by the body and communicating between the acceleration fuel pump and the fuel-and-air mixing passage between the venturi and the choke;

a cast pocket of the vacuum channel defined by the body and communicating directly with the fuel-and-air mixing passage downstream of the throttle valve; and a bore portion of the vacuum channel defined by the body and communicating directly between the cast pocket and a port defined by a continuous face of the body which is sealed to a peripheral surface of the float bowl.

* * * * *